US006523481B2

(12) United States Patent
Hara et al.

(10) Patent No.: US 6,523,481 B2
(45) Date of Patent: Feb. 25, 2003

(54) BOGIE FOR USE WITH A MONORAIL CAR

(75) Inventors: Yoshio Hara, Tokuyama (JP); Katsuyuki Iwasaki, Kudamatsu (JP); Motomi Hiraishi, Kudamatsu (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/789,754

(22) Filed: Feb. 22, 2001

(65) Prior Publication Data

US 2001/0022147 A1 Sep. 20, 2001

(30) Foreign Application Priority Data

Mar. 17, 2000 (JP) ..... 2000-081789

(51) Int. Cl.[7] ..... A63H 19/00
(52) U.S. Cl. ..... 105/141; 105/144; 104/245
(58) Field of Search ..... 105/141, 144, 105/146, 152, 154, 155; 104/89, 93, 106, 245

(56) References Cited

U.S. PATENT DOCUMENTS 2,985,114 A * 5/1961 Lindner ..... 104/118
3,902,432 A * 9/1975 Shortridge et al. ..... 105/150
4,423,685 A * 1/1984 Kerckhoff ..... 104/119
4,996,928 A * 3/1991 Jansenn et al. ..... 105/144
5,816,169 A * 10/1998 MacKenzie ..... 105/141
5,934,198 A * 8/1999 Fraser ..... 104/119

FOREIGN PATENT DOCUMENTS

JP 51139012 A * 12/1976

* cited by examiner

*Primary Examiner*—S. Joseph Morano
*Assistant Examiner*—Frantz F. Jules
(74) *Attorney, Agent, or Firm*—Antonelli, Terry, Stout & Kraus, LLP

(57) ABSTRACT

At one end in a running direction of a bogie, two guiding wheels are arranged, and at another end in the running direction of the bogie, two stabilizing wheels are arranged. The stabilizing wheels are positioned at a level lower than that of the guiding wheels. The stabilizing wheels function to guide the bogie along the monorail and prevent the bogie from falling off the track. With this arrangement, the total number of guiding wheels and stabilizing wheels can be reduced, and particularly, the number of the guiding wheels can be reduced. Accordingly, the bogie can be manufactured with a low cost. A traction link for connecting the bogie and the car body is arranged on one end of the bogie, and, accordingly the length of the bogie can be shortened.

2 Claims, 5 Drawing Sheets

BOGIE FOR USE WITH A MONORAIL CAR

BACKGROUND OF THE INVENTION

1. Technical Field

The present invention relates to a monorail car, and, more particularly, to a bogie for use with a monorail car.

2. Prior Art

In a conventional monorail car, as described in Japanese application patent publication No. Sho 62-12067, two bogies support one car body. Further, the typical bogie is comprised of running wheels for running on an upper surface of the monorail, four guiding wheels for running on both side surfaces of the monorail, and two stabilizing wheels also for running on both side surfaces of the monorail. The stabilizing wheels are arranged at a position below that of the guiding wheels and operate to prevent the car body from falling off the track.

In the above stated conventional monorail car, since two bogies are used to support one car body, it is difficult for the monorail car to run on a curved path having a small radius. Further, when the monorail car runs on a curved path having the small radius, a torsion is applied to an air spring member (an air cushion member), which is provided between the bogie and the car body, and, accordingly, the life of the air spring member becomes short.

Further, since the monorail car has as many as six wheels for each bogie (twelve wheels in all) in contact with the side surfaces of the monorail, the monorail car is high in cost.

SUMMARY OF THE INVENTION

An object of the present invention is to provide a monorail car in which a bogie of low cost can be provided.

The above-stated object of the present invention can be attained by providing a bogie having a maximum of two guiding wheels and two stabilizing wheels.

According to the present invention, in a monorail car having a bogie for running on a monorail and a car body supported by the bogie, the bogie has running wheels for rolling on an upper surface of the monorail, guiding wheels for rolling on side surfaces of the monorail, and stabilizing wheels for also rolling on the side surfaces of the monorail. The stabilizing wheels are positioned at a lower level relative to guiding wheels, and the monorail car is characterized in that there are a maximum of two guiding wheels.

According to the present invention, in a monorail car having a bogie for running on a monorail and a car body supported by the bogie, the bogie has running wheels for rolling on an upper surface of the monorail, guiding wheels for rolling on side surfaces of the monorail, and stabilizing wheels for also rolling on the side surfaces of the monorail, and the monorail car is characterized in that the bogie is connected to one end of the car body in the running direction.

According to the present invention, the monorail car is also characterized in that the bogie is comprised of two side beams extending along a running direction of the bogie and at least one cross bearer for connecting the two side beams. An axle of the running wheel is mounted on a lower surface of the side beam through a bearing seat, and a speed reducer for driving the axle is installed on a support mounted on the side beam. The output shaft of the speed reducer is provided so that it can be drawn out of the speed reducer, and the output shaft of the speed reducer and the axle are connected with a spline.

DESCRIPTION OF THE INVENTION

Figure 1:
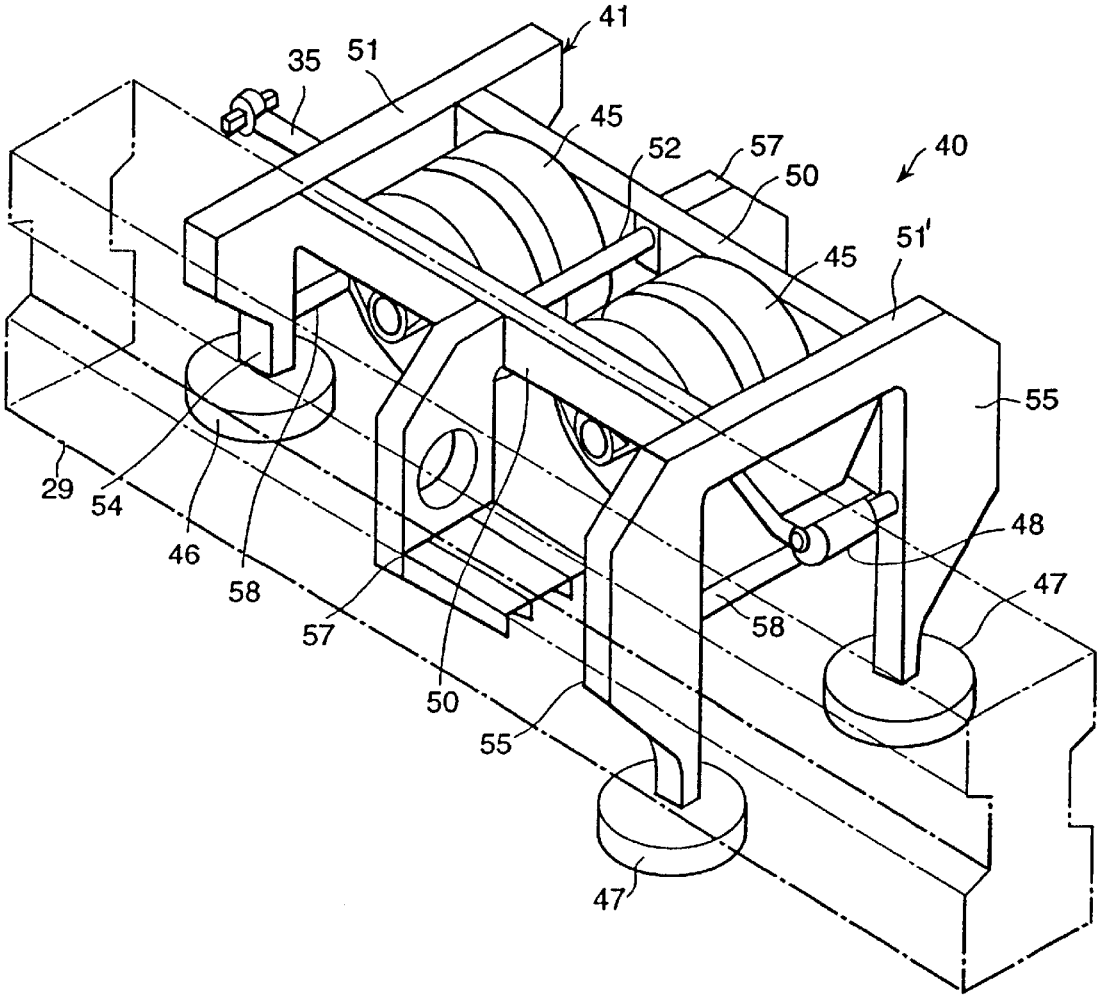
FIG. 1 is a perspective view showing a bogie for a monorail car representing one embodiment according to the present invention.

A monorail car representing one embodiment according to the present invention will be explained with reference to FIG. 1 to FIG. 6. A bogie 40 supports two car bodies 20 and 20' through four air spring members 30. In other words, the relationship of the connection between the car bodies 20 and 20' and the bogie 40 is of the junction type or the articulated type. Namely, in the junction type or the articulated type of connection of the car bodies 20 and 20' and the bogie 40, the bogie 40 is arranged between the rear end of one car body 20 and the front end of the adjacent car body 20'. Thus, the one car body 20 and the adjacent car body 20' are joined or connected by a single bogie 40 which is arranged midway between the two car bodies 20 and 20'. The air spring members 30 are installed on seats which are projected from four corner portions of a bogie frame 41 which extends in a horizontal direction.

To one end of the bogie frame 41, a traction link 35 is provided, and the traction link 35 is connected to a lower portion junction member 21 on one end of the car body 20. The car bodies 20 and 20' are connected directly together by a coupling means or a coupler not shown in the drawings.

The bogie 40 is comprised of the bogie frame 41, four running wheels 45 for rolling on an upper surface of a monorail 29, two guiding wheels 46 for rolling on respective side surfaces of the monorail 29, and two stabilizing wheels 47 for rolling on respective side surfaces of the monorail 29. The stabilizing wheels 47 are positioned along the sides of the monorail 29 at positions lower than those of the guiding wheels 46. The stabilizing wheels 47, similar to the guiding wheels 46, guide the bogie 40 along the monorail 29. In the running direction of the bogie 40, the two guiding wheels 46 are arranged at one end, and the two stabilizing wheels 47 are arranged at the other end. Wheels 48 at the front and back of the bogie are provided in contact with the upper surface of the monorail 29 to provide support when a running wheel 45 has a blow out.

The bogie frame 41 is comprised of two side beams 50, which extend along the running direction; a pair of cross bearers (lateral beams) 51 and 51' for connecting a front end and a rear end of the two side beams 50, respectively; a cross bearer (a lateral beam) 52 for connecting a central portion of the two side beams 50; four legs including a pair of legs 54 and a pair of legs 55 projecting downward from respective ends of the cross bearers 51 and 51', and on which the two guiding wheels 46 and the two stabilizing wheels 47 are mounted; cross bearers 58 to stabilize the legs 54 and 55; and seats 57 on which electric motors 61 are mounted outside of the side beams 50. The seats 57 carry electric motors 61.

The two seats 57 are connected through the coupling rod 52, and they have an L-shape, as seen from the side. The bogie frame 41 is mounted so as to straddle the monorail 29. The spring members 30 are installed on an upper portion of the cross bearers 51 and 51'.

A driving device 60 for driving the running wheels 45 will be explained. The driving device 60 is provided as two systems, one of the two systems drives one end running wheel 45 in the running direction and the other of the two systems drives another end running wheel 45 in the running direction. Each system of the driving device 60 is comprised of an electric motor 61 and a speed reducer (a reduction gear) 62.

Each electric motor 61 is mounted on a horizontal support member of a seat 57. The axial direction of the electric motor 61 is directed in the running direction. Each speed reducer 62 is installed outside of the side surface of the side beams 50. A coupling device (a coupler) for connecting an electric motor 61 to its speed reducer 62 passes through an opening in a vertical support member of the seat 57.

The electric motor 61 of one system of the driving device 60 is provided on one side of the bogie in the running direction and the electric motor 61 of the other system of the driving device 60 is provided on the other side of the bogie in the running direction. As to the speed reducer 62, a similar construction with the electric motor 61 will be explained.

Figure 2:
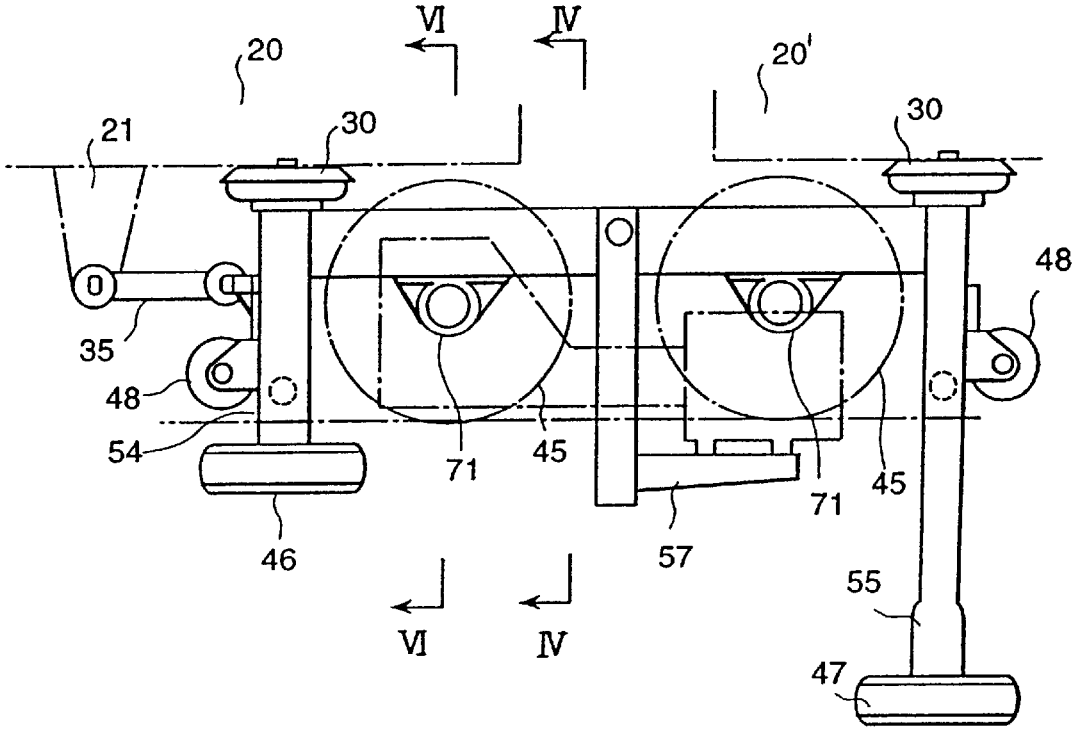
FIG. 2 is a front view showing the bogie of the monorail car shown in FIG. 1.
Figure 3:
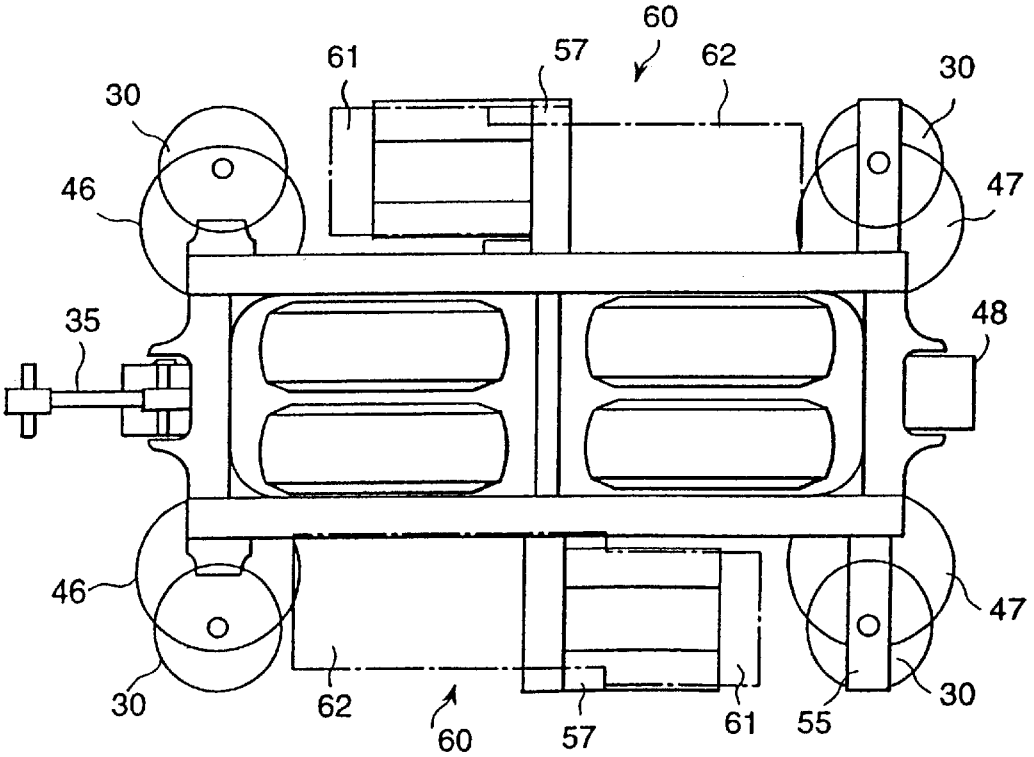
FIG. 3 is a plane view showing the bogie of the mono rail car shown in FIG. 2.
Figure 4:
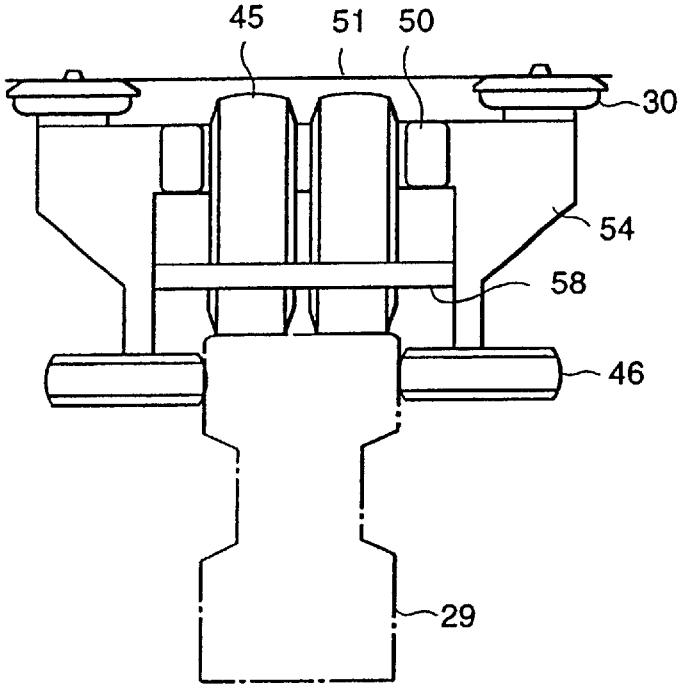
FIG. 4 is a cross-sectional view showing the bogie of the monorail car as seen along line IV—IV in FIG. 2.
Figure 5:
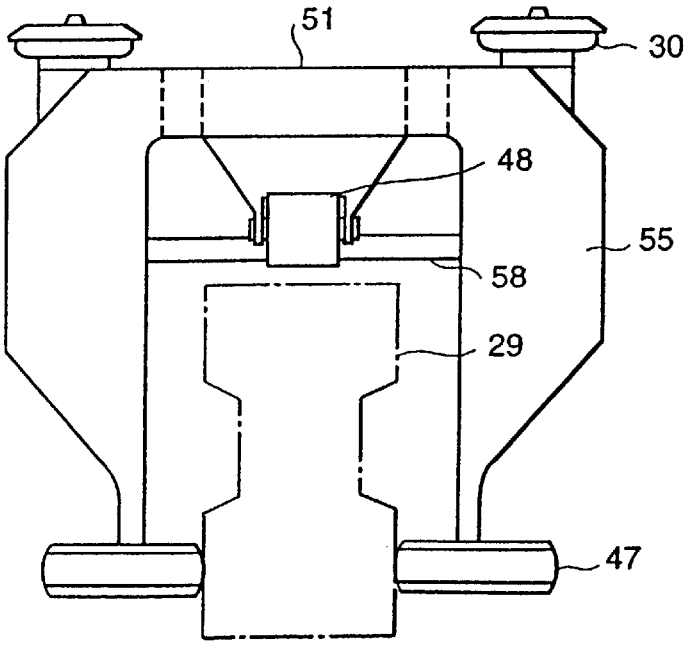
FIG. 5 is a right side view showing the bogie of the monorail car shown in FIG. 2.
Figure 6:
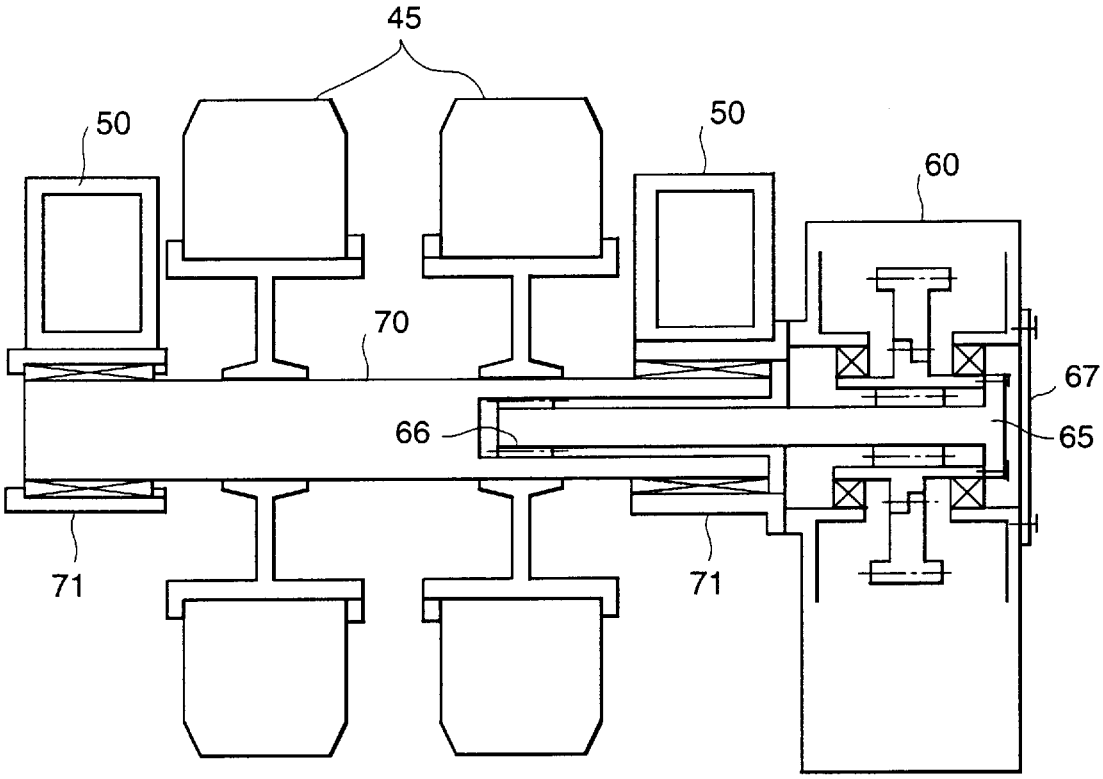
FIG. 6 is a cross-sectional view showing the bogie of the monorail car as seen along line VI—VI in FIG. 2.

Both ends of the axle 70 (FIG. 6) of the running wheels 45 are fixed to a lower surface of a side beam 50 through a bearing seat 71, as seen in FIG. 2. The bearing seat 71 is fixed to the lower surface of a side beam 50 from below through the use of bolts. An output shaft 65 of the speed reducer 62 is inserted into the driving device 60, and a tip end of the output shaft 65 and the axle 70 are connected through a spline 66.

After removing a cover 67 for providing access to a shaft portion of the speed reducer 62, by removing the bolts for fixing a flange of an end portion of the output shaft 65 and the seat, the output shaft 65 can be drawn from the speed reducer 62 toward the out side. The axle 70 can be supported at both ends thereof and the axle 70 can be constituted strongly. The running wheels 45 are fixed to the axle 70 with the use of already known means.

With the above-stated construction of the bogie for a monorail car, a procedure for exchanging the running wheel 45 will be explained. This operation is carried out at the works. First of all, the car body 20 is removed. Next, the connection between the side beams 50 and the casing of the speed reducer 62 is removed. This operation is carried out by removing the bolts from an inner side of the side beams 50.

Then, the bearing seat 71 is removed from a lower portion of the side beams 50. Further, the cover 67 is removed and the flange fixing the end portion of the output shaft 65 is removed, and then the output shaft 65 is removed, as described above. After that, the bogie frame 40 is lifted upwards. Since the running wheel 45 having the axle 70 and the bearing seat 71 is left, it is possible to carry out the operation of exchanging the running wheel 45.

Since the two car bodies 20 and 20' are supported by one bogie 40, the monorail car can run easily along a path having a small radius. Further, as a result, the torsion of the air spring member 30 becomes small, so that it is possible to achieve increased longevity in the use of the air spring member 30.

Further, when the monorail car runs in a direction toward the side of the guiding wheel 46, the guiding wheel 46 guides the bogie 40 along the monorail 29. When the monorail car runs in a direction toward the side of the stabilizing wheel 47, the stabilizing wheel 47 guides the bogie 40 along the monorail 29.

The prevention of the bogie 40 from falling off the track is carried out mainly by the stabilizing wheel 47, similar to that of the prior art. For this reason, the number of guiding wheels 46 can be reduced by half, so that the bogie 40 for the monorail car can be constituted with a low cost.

In the prior art, the junction member 21 for connecting the bogie 40 to the car body 20 and the traction link 35 connected thereto are arranged between the front and the rear cross bearers 51 and 51'. However, according to the present invention, since the junction member 21 and the traction link 35 are arranged on one end of the bogie 40, the interval between the two axles 70 can be shortened, whereby the monorail car is able to easily travel along a path having a small curvature. Further, the space in the vertical direction between the car body 20 and the bogie 40 can be small.

Figure 7:
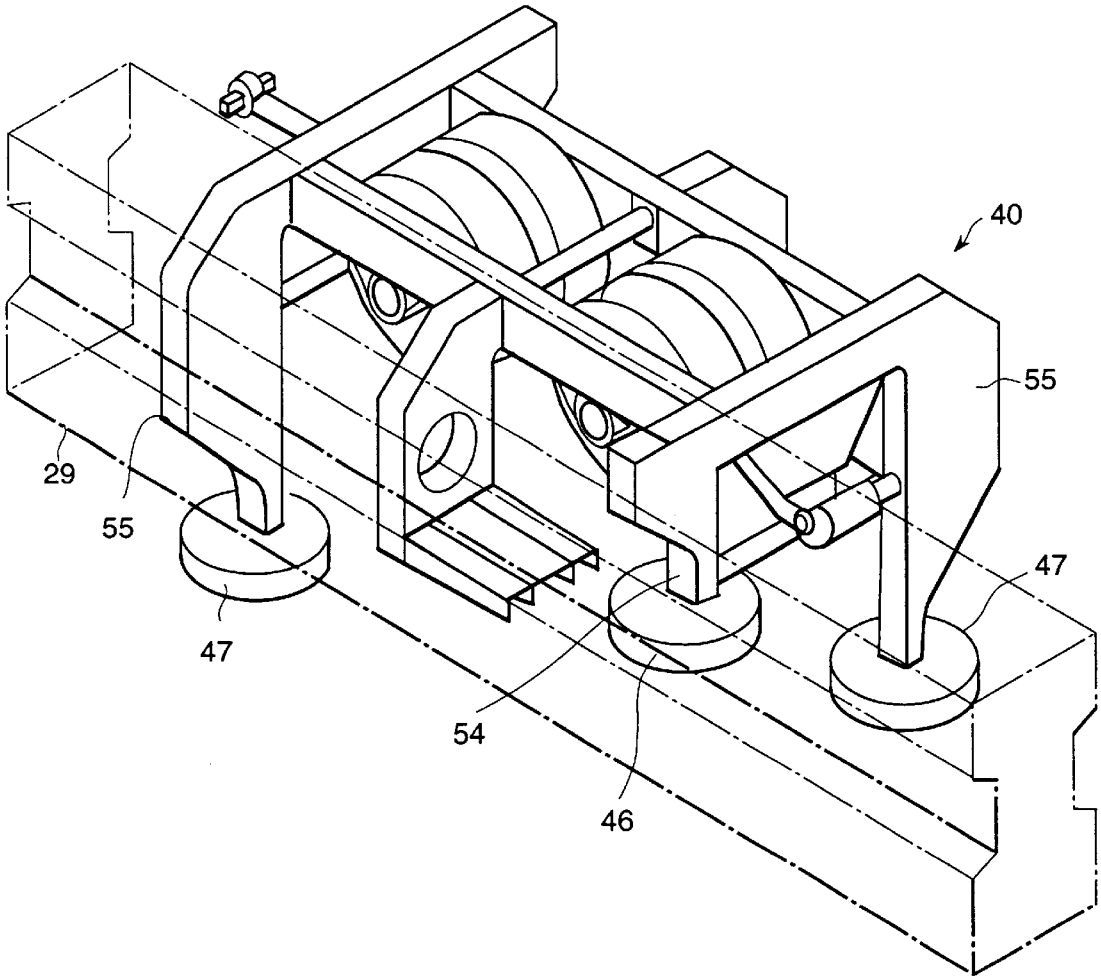
FIG. 7 is a perspective view showing a bogie for a monorail car representing another embodiment according to the present invention.

Another embodiment of a bogie for a monorail car, as shown in FIG. 7, will be explained. In the running direction, on one end of the bogie, a guiding wheel 46 and a stabilizing wheel 47 are arranged, and on the other end of the bogie, a guiding wheel 46 and a stabilizing wheel 47 are arranged. In a rear portion of the guiding wheel 46, the stabilizing wheel 47 is arranged. In other words, a combination of one guiding wheel 46 and one stabilizing wheel 47 is arranged with mirror image construction in the front and the rear directions, respectively.

According to the present invention, since the stabilizing wheel also performs the function of the guiding wheel, the total number of guiding wheels and stabilizing wheels can be reduced; and, more particularly, the number of guiding wheels can be reduced, so that the bogie for a monorail car can be formed with a low cost.

What is claimed is:

1. In a monorail car having a bogie for running on a monorail and a car body supported by said bogie;

said bogie has running wheels for rolling on an upper face on said monorail, guiding wheels for rolling on side faces of said monorail, and stabilizing wheels for rolling on said side faces of said monorail; and wherein said bogie is comprised of two side beams which extend along a running direction of said bogie and a cross bearer for connecting said two side beams;

an axle of said running wheels is installed to lower faces of said side beams through respective bearing seats;

a speed reducer for driving said axle is installed to one of said side beams;

an output shaft of said speed reducer is provided to be drawn to an outer portion from said speed reducer; and said output shaft of said speed reducer and said axle are connected with a spline.

2. A monorail system comprising a monorail, first and second car bodies arranged in end-to-end relation along the monorail, and a bogie for running on the monorail;

said bogie having running wheels for rolling on an upper face on said monorail, guiding wheels for rolling on side faces on said monorail, and stabilizing wheels for rolling on said side faces of said monorail;

said bogie including two side beams extending along a running direction of said bogie and a cross bearer for connecting said two side beams;

an axle of said running wheels is installed to lower faces of said side beams through respective bearing seats;

a speed reducer for driving said axle is installed to one of said side beams;

an output shaft of said speed reducer is provided to be drawn to an outer portion from said speed reducer; and said output shaft of said speed reducer and said axle are connected with a spline;

wherein one end of a running direction of said bogie and an adjacent end of one of the first and second car bodies are connected.

* * * * *